US009104218B2

(12) United States Patent
Bhattad et al.

(10) Patent No.: US 9,104,218 B2
(45) Date of Patent: Aug. 11, 2015

(54) CLEAN STARTUP AND POWER SAVING IN PULSED ENABLING OF LDO

(71) Applicant: Dialog Semiconductor GmbH, Kirchheim/Teck-Nabern (DE)

(72) Inventors: Ambreesh Bhattad, Swindon (GB); Ludmil Nikolov, Chippenham (GB)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 60 days.

(21) Appl. No.: 13/756,564

(22) Filed: Feb. 1, 2013

(65) Prior Publication Data

US 2014/0210440 A1 Jul. 31, 2014

(30) Foreign Application Priority Data

Jan. 25, 2013 (EP) ..... 13392002

(51) Int. Cl.

| | |
|---|---|
| ***G05F 1/00*** | (2006.01) |
| ***G05F 3/04*** | (2006.01) |
| ***G05F 3/08*** | (2006.01) |
| ***G05F 1/46*** | (2006.01) |
| ***G05F 1/56*** | (2006.01) |

(52) U.S. Cl.

CPC ... *G05F 1/46* (2013.01); *G05F 1/56* (2013.01)

(58) Field of Classification Search

USPC ..... 323/273, 280, 311

See application file for complete search history.

(56) References Cited

U.S. PATENT DOCUMENTS

| | | | | |
|---|---|---|---|---|
| 6,977,490 | B1 * | 12/2005 | Zhang et al. | 323/280 |
| 7,276,885 | B1 | 10/2007 | Tagare | |
| 7,495,422 | B2 * | 2/2009 | Mok et al. | 323/280 |
| 7,531,996 | B2 | 5/2009 | Yang et al. | |
| 2002/0089317 | A1 | 7/2002 | Khouri et al. | |
| 2005/0073286 | A1 | 4/2005 | Ke et al. | |
| 2006/0108993 | A1 | 5/2006 | Chien et al. | |
| 2007/0252564 | A1 * | 11/2007 | De Nisi et al. | 323/268 |
| 2009/0309562 | A1 | 12/2009 | Lipcsei et al. | |
| 2011/0095744 | A1 * | 4/2011 | Unetich et al. | 323/311 |
| 2011/0156672 | A1 | 6/2011 | Gakhar et al. | |

OTHER PUBLICATIONS

European Search Report 13392002.5-1807 Mailed: Jul. 3, 2013, Dialog Semiconductor GmbH.

* cited by examiner

*Primary Examiner* — Adolf Berhane
*Assistant Examiner* — Gary Nash
(74) *Attorney, Agent, or Firm* — Saile Ackerman LLC; Stephen B. Ackerman

(57) ABSTRACT

Circuits and methods to achieve a clean start-up process and power saving of pulsed enabled electronic devices having an output capacitor and components requiring biasing during normal operating conditions are disclosed. These electronic devices could be e.g. LDOs, amplifiers or buffers. A set of switches are enabling bias currents from the output capacitor to internal nodes requiring biasing under normal operational conditions as e.g. output nodes of amplifying means.

31 Claims, 3 Drawing Sheets

CLEAN STARTUP AND POWER SAVING IN PULSED ENABLING OF LDO

BACKGROUND (1) Technical Field

The present document relates to DC-to-DC converters or amplifiers. In particular, the present document relates to a method and system for biasing internal nodes from reservoir capacitor during power down rather from battery.

(2) Background

In existing designs the output of a low drop-out (LDO) regulator or amplifier or buffer is pulled down and an output capacitor is discharged actively when the system as e.g. an LDO is powered down.

If the system as e.g. an LDO is frequently enabled and disabled a lot of power would be wasted in charging and actively discharging an external reservoir capacitor.

Even if the pull down was disabled to save power a clean startup cannot be guaranteed under all operating conditions. It would always depend on the discharged value of the output capacitor. The startup time specification would be violated along with overshoot and under shoot at the output.

This leads to following disadvantages

1. Increased power consumption in pulsed enabling of LDO or other systems
2. No guaranteed clean start-up process
3. Power consumption from battery or other supply required to bias the internal nodes under power down condition It is a challenge for engineers to design biasing of internal nodes, enabling a clean start-up process while minimizing power consumption.

SUMMARY

A principal object of the present disclosure is to achieve biasing internal nodes from output capacitor during power down in order to facilitate a clean start-up process.

A further object of the disclosure is to achieve a clean startup process regardless if output is actively discharged or not.

A further object of the disclosure is to achieve power saving in pulsed enabling of LDOs or other circuits.

Moreover a key object of the disclosure is to discharge an output capacitor of circuits actively and enable recycling of said charge.

In accordance with the objects of this disclosure a method to achieve a clean start-up process and power saving of pulsed enabled electronic devices having an output capacitor and components requiring biasing during normal operating conditions has been achieved. The method disclosed comprises the following steps: (1) providing a pulsed enabled electronic device having an output capacitor and components requiring biasing, (2) biasing internal nodes of the device from the output capacitor during power down of the electronic device and (3) using the energy stored in the output capacitor and/or energy recycling.

In accordance with the objects of this disclosure a circuit to achieve a clean start-up process and power saving of pulsed enabled electronic devices having an output capacitor and components requiring biasing during normal operating conditions has been disclosed. The circuit disclosed firstly comprises: an output capacitor and components of the electronic device requiring biasing during normal operating conditions. Furthermore the circuit comprises a port for an enabling/disabling signal, and a set of switches enabling bias current from the output capacitor to internal nodes of the electronic device requiring bias current under normal operating conditions, wherein the switches are controlled by said enabling/disabling signal.

In accordance with the objects of this disclosure a circuit to achieve a clean start-up process and power saving of a pulsed enabled LDO having an output capacitor and amplifying means requiring biasing during normal operating conditions has been achieved. The circuit disclosed firstly comprises: a port for an enabling/disabling signal of the LDO, an output capacitor, and an error amplifier receiving a reference voltage and a fraction of the output voltage from a voltage divider and an output of the error amplifier is an input of an amplifying means. Furthermore the circuit comprises said amplifying means receiving input from said error amplifier, said voltage divider, connected between an output voltage of the LDO and ground, and a set of switches enabling bias current from the output capacitor to internal nodes of the electronic device requiring bias current under normal operating conditions, wherein the switches are controlled by said enabling/disabling signal.

BRIEF DESCRIPTION OF THE DRAWINGS

In the accompanying drawings forming a material part of this description, there is shown.

DESCRIPTION OF THE PREFERRED EMBODIMENTS

Methods and circuits to achieve a clean startup process and power saving in pulsed enabling of an LDO or suitable amplifier or buffer by biasing internal nodes from reservoir capacitor during power down rather than from battery are disclosed.

Figure 3:
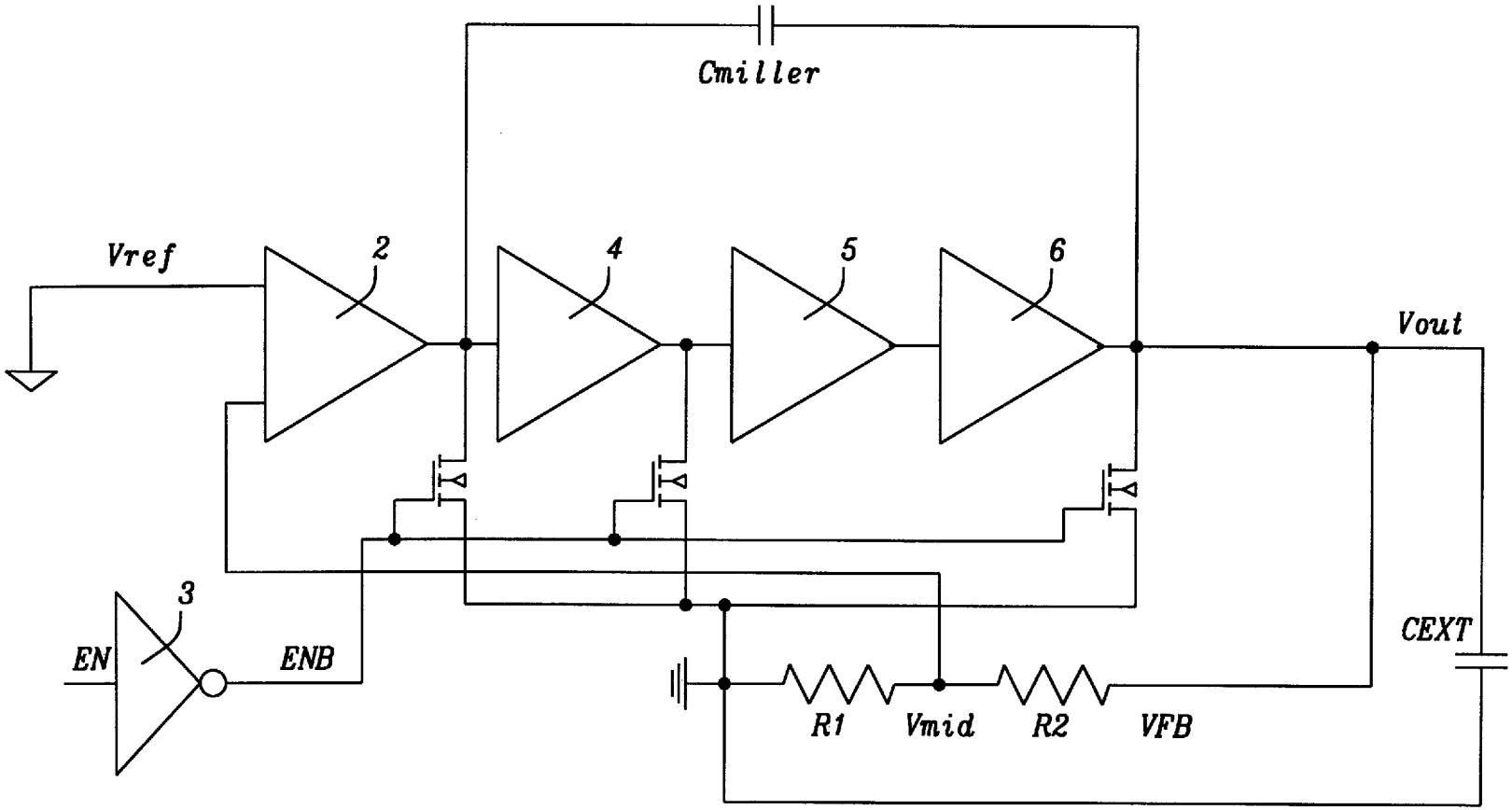
FIG. 3 shows basic elements of an implementation of an LDO to illustrate how the LDO is pulled down and an output capacitor is discharged actively when the LDO is powered down.

FIG. 3 shows basic elements of an implementation of an LDO to illustrate how the LDO is pulled down and an output capacitor is discharged actively when the LDO is powered down.

The circuit of FIG. 3 shows an LDO comprising a differential error amplifier 2 comparing a reference voltage $V_{REF}$ with a mid-voltage $V_{MID}$ of a voltage divider R1/R2 representing a fixed fraction of the output voltage Vout. Furthermore an output capacitor $C_{EXT}$ is shown, which is connected between the output port of the LDO and ground.

An enabling signal EN is used for a frequent switching ON/OFF of the LDO. In the non-limiting example of the LDO shown in FIG. 3, the signal EN is inverted by inverter 3 to signal ENB.

The capacitor $C_{miller}$, connected between the output of the error amplifier and the point $V_{FB}$, which is close to the output of the LDO, increases an equivalent input capacitance of the LDO due to amplification of the effect of the capacitor $C_{miller}$ between the input and output terminals.

Amplification stages 4-6 of a multistage amplifier are deployed to amplify the output of the error amplifier 2.

A disadvantage of this implementation is that in case the LDO is frequently enabled and disabled a lot of power would be wasted in charging of the external reservoir capacitor. Even if the pull down was disabled to save power a clean startup cannot be guaranteed under all operating conditions. It would always depend on the discharged value of the output capacitor. The startup time specification would be violated along with overshoot and under shoot at the output.

Figure 1:
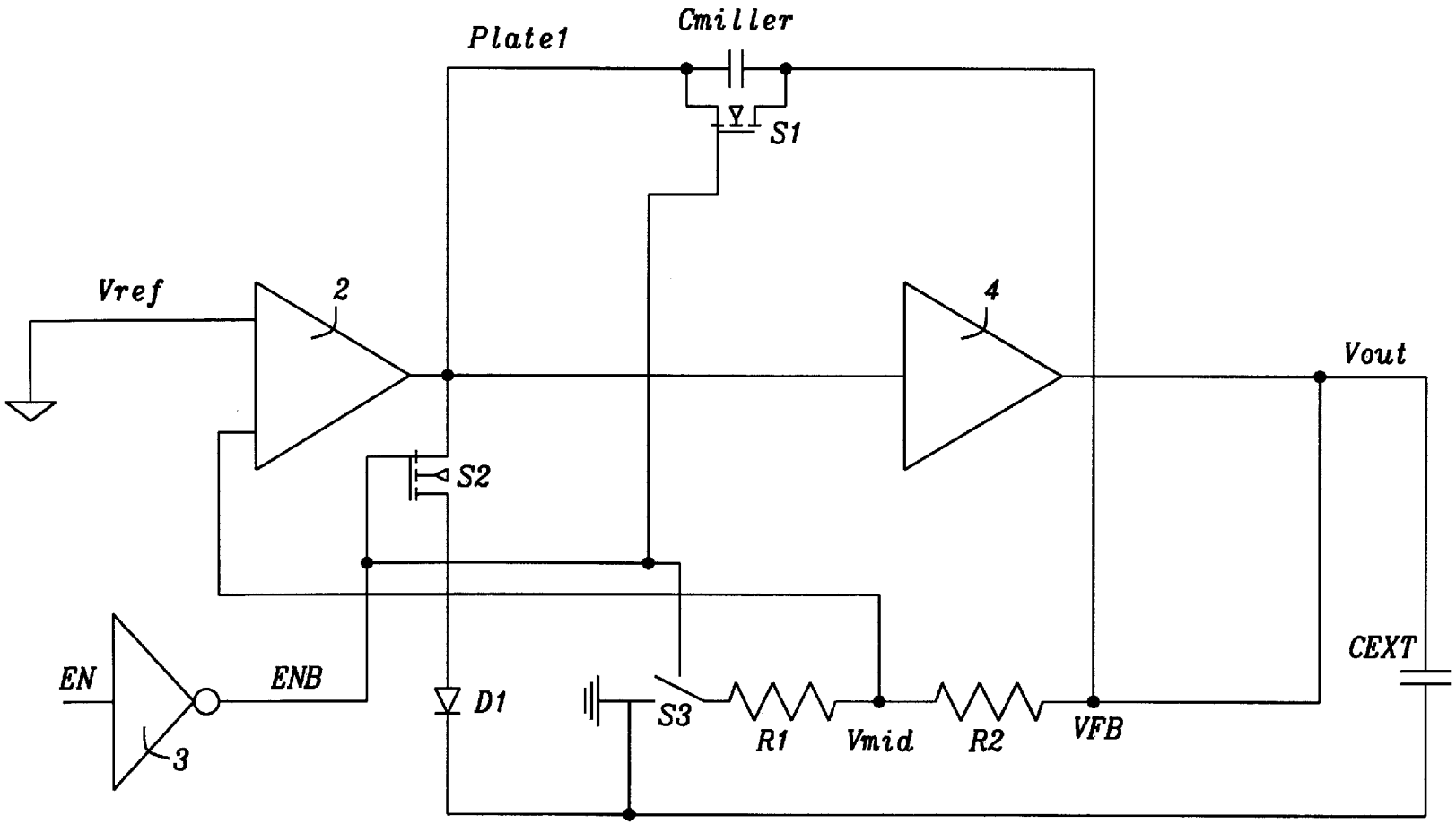
FIG. 1 shows basic elements of a preferred embodiment of the disclosure applied to an LDO.

FIG. 1 shows the basic elements of a preferred embodiment of the disclosure applied as a non-limiting example to an LDO. The circuit of FIG. 1 shows an LDO 1 comprising a differential error amplifier 2 comparing a reference voltage $V_{REF}$ with a mid-voltage $V_{MID}$ of a voltage divider R1/R2 representing a fixed fraction of the output voltage Vout. Furthermore an output capacitor $C_{EXT}$ is shown, which is for example implemented externally of an integrated IC, in which the LDO 1 may be deployed. The output capacitor $C_{EXT}$ is connected between the output port of the LDO 1 and ground.

An enabling signal EN is used for a frequent switching ON/OFF of the LDO 1. In the non-limiting example of the LDO 1 shown in FIG. 1 the signal EN is inverted by inverter 3 to signal ENB.

The capacitor $C_{miller}$, connected between the output of the error amplifier and the point $V_{FB}$, which is close to the output of the LDO 1, increases an equivalent input capacitance of the LDO 1 due to amplification of the effect of the capacitor $C_{miller}$ between the input and output terminals.

The pass device 4 is deployed between the error amplifier 2 and the output node Vout. An amplifier, which may be a multi-stage amplifier, may be deployed between error amplifier 2 and the pass device 4.

A first switch S1 is deployed across the capacitor $C_{miller}$, a second switch S2 is connected between the output node of the error amplifier 2 and via a diode D1 to ground, and an optional third switch S3 is connected between the a resistive voltage divider R1/R2 and ground. All switches S1-S3 are controlled by the ENB signal, i.e. switches S1 and S2 are closed and switch S3 is opened when the LDO is disabled (power down). The diode D1 acts as a clamping circuit to bias the output of error amplifier 2.

When LDO 1 is powered down, the output is not pulled low as usually done via a switch but, as a key point of the disclosure, switches S1, S2 are closed, i.e. closing switches S1 and S2 provides a bias current to correctly bias the output of amplifier as it would be under normal operating conditions. The bias current is provided by the reservoir capacitor $C_{EXT}$ and not from the supply or battery. The loss of power through resistive divider R1/R2 is avoided by opening the optional switch S3 during power down of the LDO while switch S3 is closed during normal operation.

In summary biasing of internal nodes as the output of error amplifier 2 and the plate of the Miller capacitor that is not connected to output, get biased. The clamping diode D1, which may be implemented as a MOS transistor in diode configuration, is put parallel to output of the error amplifier. Switch S2 is closed in power down condition and provides the path for bias current for the clamping diode. This diode maintains the voltage at output of differential amplifier and the plate of miller capacitor not connected to output node Vout.

It should be noted that the method and circuit disclosed could be applied for pulsed enabled electronic devices other than LDOs as well as e.g. to amplifiers and buffers, if these devices are implemented with an output capacitor and components requiring biasing under normal operation conditions.

Figure 2:
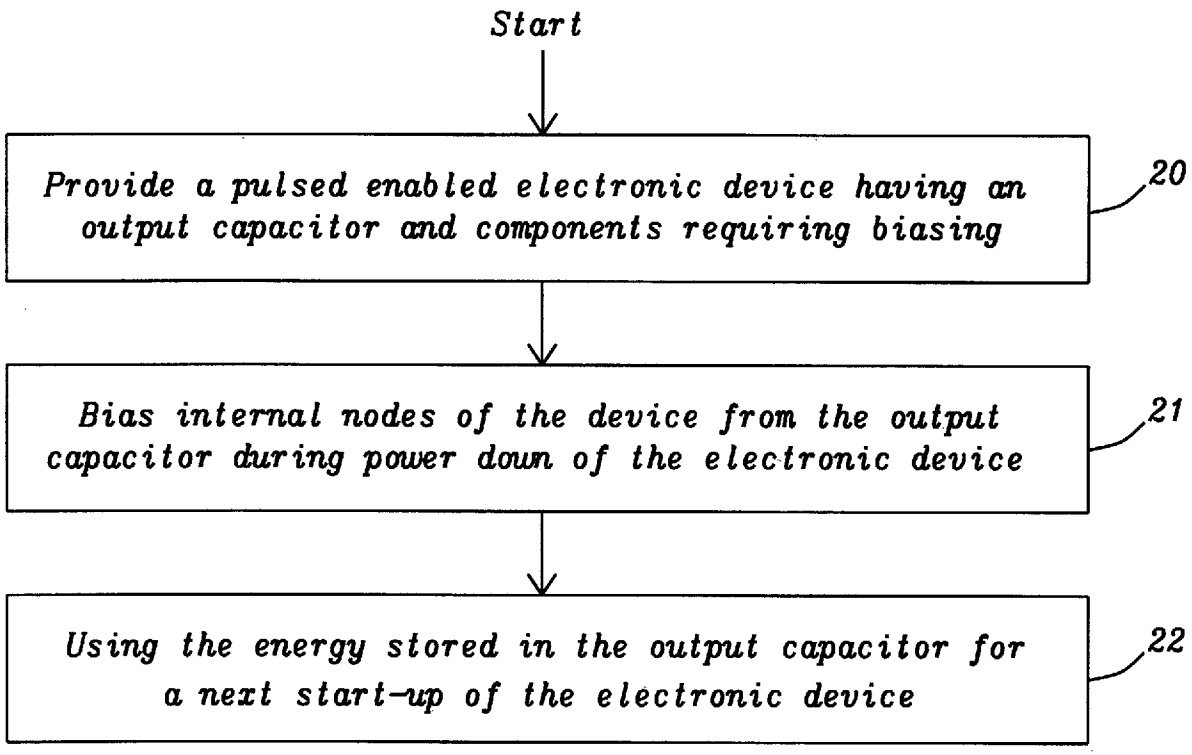
FIG. 2 illustrates a flowchart of a method to achieve a clean start-up process and power saving in pulsed enabled electronic devices having an output capacitor and components requiring biasing under normal operating conditions.

FIG. 2 illustrates a flowchart of a method to achieve a clean start-up process and power saving in pulsed enabled electronic devices having an output capacitor and components requiring biasing under normal operating conditions. Step 20 of the method of FIG. 2 illustrates the provision of a pulsed enabled electronic device having an output capacitor and components requiring biasing under normal operating conditions. The nodes to be biased are usually output nodes of amplifying means. Step 21 depicts biasing internal nodes of the device from the output capacitor during power down of the electronic device and step 22 shows using the energy stored in the output capacitor and/or energy recycling for the next start-up of the electronic device.

It should be noted that the method disclosed above is especially efficient when a start-up process follows the process of step (3) and involves biasing the internal nodes e.g. via a rectifying (i.e. uni-directional) element as diodes etc.

While the disclosure has been particularly shown and described with reference to the preferred embodiments thereof, it will be understood by those skilled in the art that various changes in form and details may be made without departing from the spirit and scope of the disclosure.

What is claimed is:

1. A method to achieve a clean start-up process and power saving of pulsed enabled electronic devices having an output capacitor and components requiring biasing during normal operating conditions, comprising the following steps:

(1) providing a pulsed enabled electronic device having an output capacitor and components requiring biasing; and (2) biasing internal nodes of the device from the output capacitor during power down of the electronic device; and (3) using the energy stored in the output capacitor for the next process of the electronic device.

2. The method of claim 1, wherein a directly following process is a start-up process.

3. The method of claim 1, wherein a following process involves biasing the internal nodes.

4. The method of claim 3, wherein the biasing of the internal nodes occurs via a rectifying element.

5. The method of claim 1 wherein said electronic device is a low drop-out regulator.

6. The method of claim 5 wherein the biasing of internal nodes comprises biasing an output of an error amplifier and a plate of a Miller capacitor, which is not connected to an output node of the low drop-out regulator.

7. The method of claim 5 wherein a switch is disconnecting a resistive voltage divider from ground during power-down of the low drop-out regulator.

8. The method of claim 1 wherein said electronic device is an amplifier.

9. The method of claim 1 wherein said electronic device is a buffer.

10. The method of claim 1 wherein said biasing during power down is performed via switches connecting the output capacitor to internal nodes of the electronic device to be biased.

11. The method of claim 1 wherein said internal nodes are output nodes of amplifying means of the electronic device.

12. A circuit to achieve a clean start-up process and power saving of pulsed enabled electronic devices having an output capacitor and components requiring biasing during normal operating conditions, comprising:

said output capacitor, configured for biasing components of the circuit during power down of the electronic device;

a port for an enabling/disabling signal; and a set of switches configured to activate has currents during power down of the electronic device from the output capacitor to internal nodes of the electronic device requiring bias current under normal operating conditions, wherein the switches are controlled by said enabling/disabling signal.

13. The circuit of claim 12 wherein said electronic device is a low drop-out regulator.

14. The circuit of claim 13 wherein said internal nodes requiring biasing comprise an output node of an error amplifier and a plate of a Miller capacitor, which is not connected to an output node of the low drop-out regulator.

15. The circuit of claim 13 wherein a switch is disconnecting a resistive voltage divider from ground during power-down of the low drop-out regulator.

16. The circuit of claim 12 wherein said electronic device is an amplifier.

17. The circuit of claim 12 wherein said electronic device is a buffer.

18. A circuit to achieve a clean start-up process and power saving of pulsed enabled electronic devices having an output capacitor and components requiring biasing during normal operating conditions, comprising:

an output capacitor, configured for biasing components of the circuit during power down of the electronic device;

components of the electronic device requiring biasing during normal operating conditions;

a port for an enabling/disabling signal; and a set of switches configured to activating has current during power down of the electronic device from the output capacitor to internel nodes of the electronic device requiring bias current under normal operating conditions, wherein the switches are controlled by said enabling/disabling signal.

19. The circuit of claim 18 wherein said electronic device is a low drop-out regulator.

20. The circuit of claim 19 wherein said internal nodes requiring biasing comprise an output node of an error amplifier and a plate of a Miller capacitor, which is not connected to an output node of the low drop-out regulator.

21. The Circuit of claim 18 wherein a switch is disconnecting a resistive voltage divider from ground during power-down of a low drop-out regulator.

22. The circuit of claim 18 wherein said electronic device is an amplifier.

23. The circuit of claim 18 wherein said electronic device is a buffer.

24. The circuit of claim 18 wherein said internal nodes are output nodes of amplifying means of the electronic device.

25. The circuit of claim 18 wherein a Miller capacitor is snorted during power down.

26. A circuit to achieve a clean start-up process and power saving of a pulsed enabled LDO having an output capacitor and amplifying means requiring biasing during normal operating conditions, comprising:

a port for an enabling/disabling signal of the LDO;

an output capacitor configured for biasing said amplifying means during power down of the electronic device;

an error amplifier receiving a reference voltage and a fraction of an output voltage from a voltage divider and an output of the error amplifier is an input of an amplifying means;

said amplifying means receiving input from said error amplifier;

said voltage divider, connected between the output voltage of the LDO and ground; and a set of switches configured to activating bias current during power down of the electronic device, from the output capacitor to internal nodes of an electronic device requiring bias current under normal operating conditions, wherein the switches are controlled by said enabling/disabling signal.

27. The circuit of claim 26 wherein said set of switches comprises two switches, wherein a first switch is connected between an output of the error amplifier and ground and a second switch is connected between the output of said amplifying means and ground.

28. The circuit of claim 26 wherein a Miller capacitor is implemented between the output of the error amplifier and the output of the LDO, wherein the Miller capacitor is shortened by an additional switch activated by said enable/disable signal during power down of the LDO.

29. The circuit of claim 26 wherein output nodes of additional amplifying means of the LDO are receiving bias currents from the output capacitor during power down.

30. The circuit of claim 26 wherein said internal nodes requiring biasing comprise an output node of an error amplifier and a plate of a Miller capacitor, which is not connected to an output node of the low drop-out regulator.

31. The circuit of claim 26 wherein a switch is disconnecting a resistive voltage divider from ground during power-down of the low drop-out regulator.

* * * * *